US007387544B1

(12) United States Patent
Hsu

(10) Patent No.: US 7,387,544 B1
(45) Date of Patent: Jun. 17, 2008

(54) LAMP SOCKET ADAPTER TO CONVERT A SCREW TYPE SOCKET INTO A SLOT TYPE SOCKET IRREVERSIBLY

(75) Inventor: Keen Hsu, Taichung (TW)

(73) Assignee: Dong Guan Bright Yinhuey Lighting Co., Ltd., Guang Dong (CN)

( * ) Notice: Subject to any disclaimer, the term of this patent is extended or adjusted under 35 U.S.C. 154(b) by 0 days.

(21) Appl. No.: 11/745,571

(22) Filed: May 8, 2007

(51) Int. Cl.
*H01R 24/00* (2006.01)

(52) U.S. Cl. ..... 439/699.2; 439/300; 439/667

(58) Field of Classification Search ..... 439/300, 439/699.2, 667
See application file for complete search history.

(56) References Cited

U.S. PATENT DOCUMENTS 5,065,292 A * 11/1991 Aubrey ..... 362/260
5,634,820 A * 6/1997 Vakil ..... 439/646
5,700,754 A * 12/1997 Inui et al. ..... 502/340
6,250,947 B1 * 6/2001 Holzer ..... 439/379
6,494,730 B1 * 12/2002 Yan ..... 439/226
7,198,500 B1 * 4/2007 Lin ..... 439/300

* cited by examiner

*Primary Examiner*—Truc T Nguyen
(74) *Attorney, Agent, or Firm*—Alan Kamrath; Kamrath & Associates PA

(57) ABSTRACT

A lamp socket adapter includes an adapter body, a threaded sleeve, a slot type socket, two locking bars, and two elastic members. Thus, the lamp socket adapter converts a screw type socket into a slot type socket irreversibly. In addition, the arc-shaped guide face of each of the locking bars is directed toward a rotation direction of the outer thread of the threaded sleeve to guide rotation of the outer thread of the threaded sleeve.

18 Claims, 6 Drawing Sheets

LAMP SOCKET ADAPTER TO CONVERT A SCREW TYPE SOCKET INTO A SLOT TYPE SOCKET IRREVERSIBLY

BACKGROUND OF THE INVENTION

1. Field of the Invention

The present invention relates to an adapter and, more particularly, to a lamp socket adapter.

2. Description of the Related Art

A conventional incandescent lamp has a screw base screwed into a screw type socket to attach the incandescent lamp to the screw type socket. The incandescent lamp usually consumes a larger amount of electrical energy, so that the incandescent lamp is replaced by an energy-saving lamp. However, the energy-saving lamp has a base formed with two pins that are inserted into two slots of a slot type socket so that the energy-saving lamp is only available for a slot type socket and cannot be mounted on a screw type socket. A conventional lamp socket adapter is mounted between a slot type socket and a screw type socket to convert the screw type socket into the slot type socket. However, the conventional lamp socket adapter is easily removed from the screw type socket.

BRIEF SUMMARY OF THE INVENTION

In accordance with the present invention, there is provided a lamp socket adapter, comprising an adapter body having a first side formed with a protruding mounting portion, a threaded sleeve mounted on the mounting portion of the adapter body and having an outer wall formed with an outer thread, a slot type socket mounted on a second side of the adapter body and formed with two slots, two locking bars each mounted between the adapter body and the slot type socket and each having a first end mounted on the slot type socket and a second end which protrudes outwardly from the mounting portion of the adapter body and has a first side formed with an arc-shaped guide face and a second side formed with a flattened locking face located opposite to the arc-shaped guide face, and two elastic members each biased between the slot type socket and a respective locking bar to push the respective locking bar toward the adapter body and to push the second end of the respective locking bar outwardly from the mounting portion of the adapter body.

The primary objective of the present invention is to provide a lamp socket adapter to convert a screw type socket into a slot type socket irreversibly.

Another objective of the present invention is to provide a lamp socket adapter, wherein the lamp socket adapter is mounted on a screw type socket to convert the screw type socket into the slot type socket.

A further objective of the present invention is to provide a lamp socket adapter, wherein the arc-shaped guide face of each of the locking bars is directed toward a rotation direction of the outer thread of the threaded sleeve to guide rotation of the outer thread of the threaded sleeve so that the outer thread of the threaded sleeve is screwed into the inner thread of the mounting stud of the screw type socket smoothly and stably.

A further objective of the present invention is to provide a lamp socket adapter, wherein the locking bars are arranged symmetrically to produce a evenly distributed moment.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
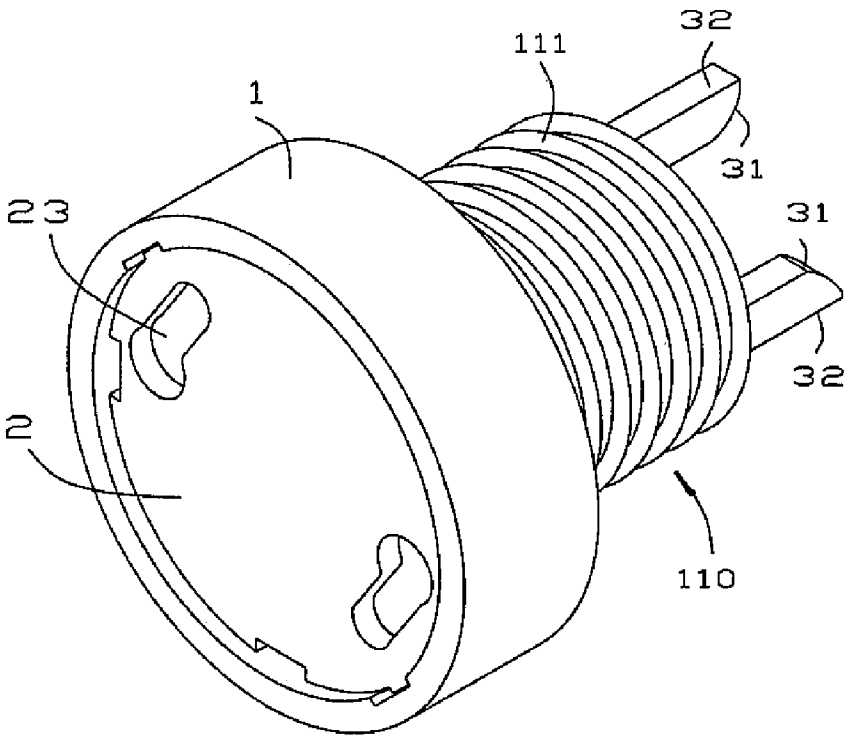
FIG. 1 is a perspective view of a lamp socket adapter in accordance with the preferred embodiment of the present invention.
Figure 2:
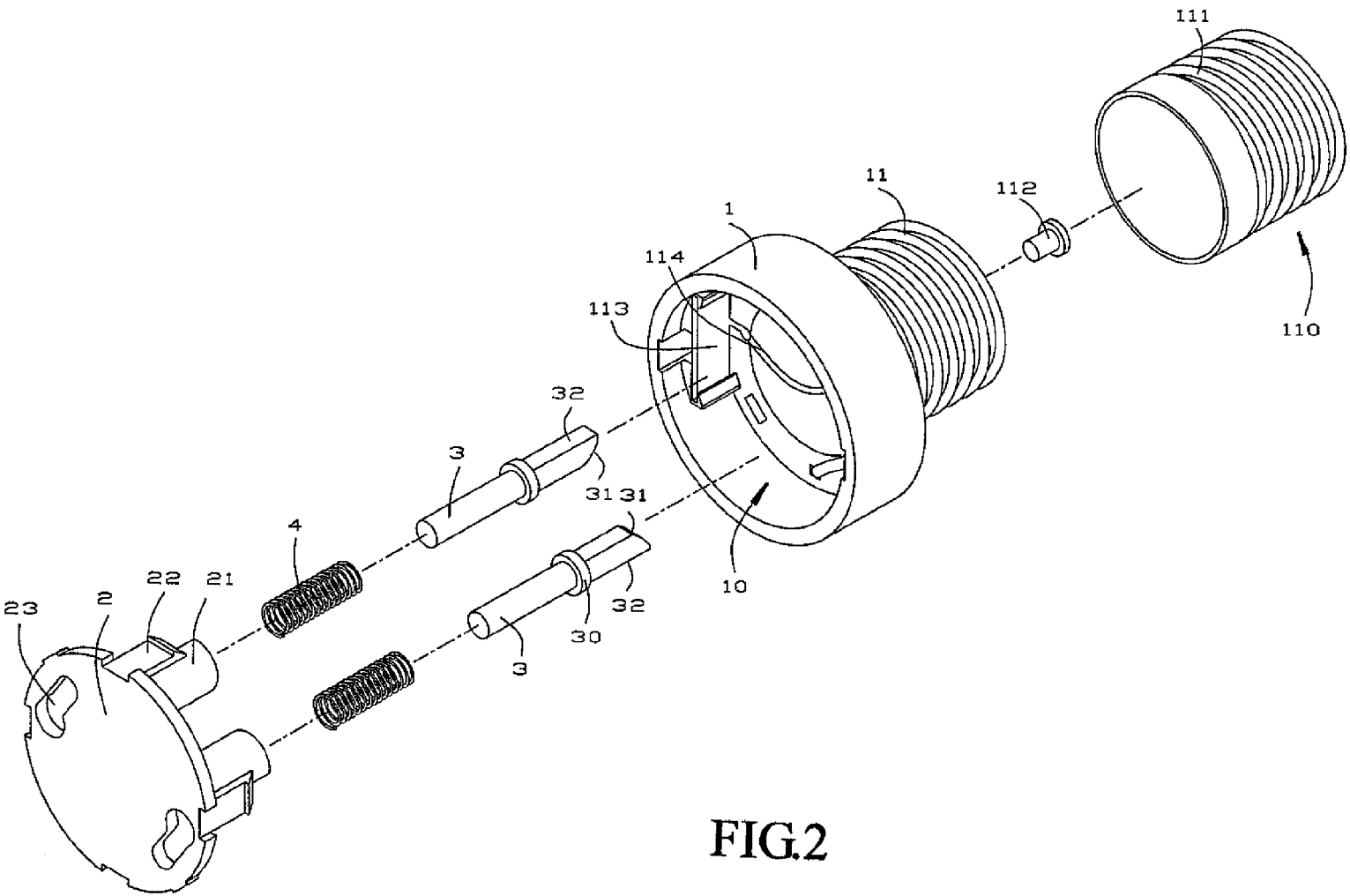
FIG. 2 is an exploded perspective view of the lamp socket adapter as shown in FIG. 1.
Figure 5:
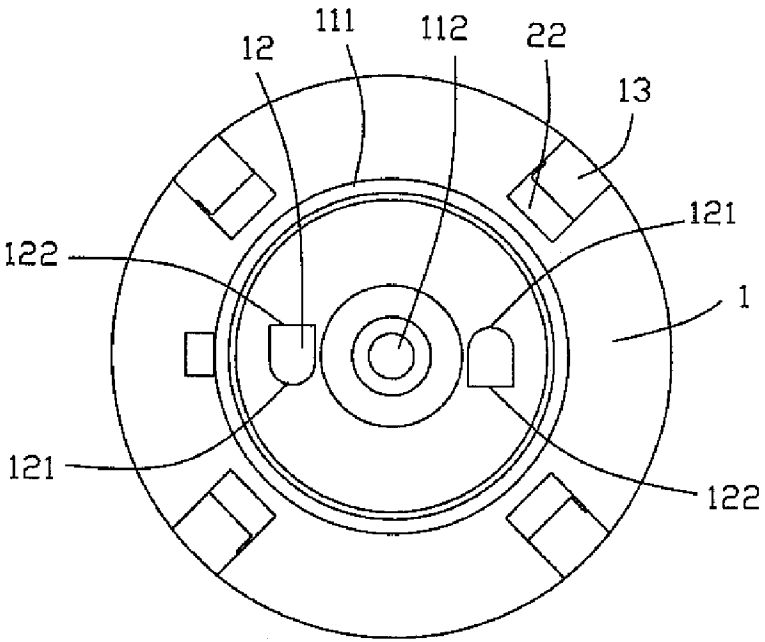
FIG. 5 is a side view of the adapter body of the lamp socket adapter as shown in FIG. 4.
Figure 3:
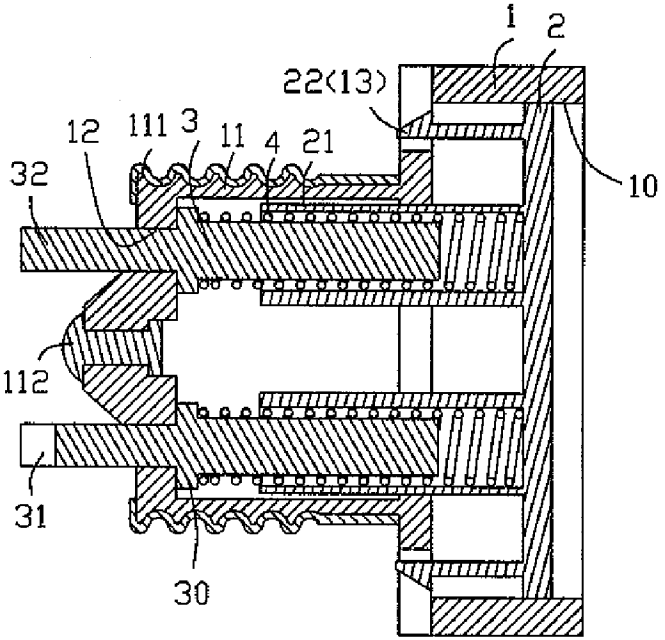
FIG. 3 is a side cross-sectional view of the lamp socket adapter as shown in FIG. 1.
Figure 4:
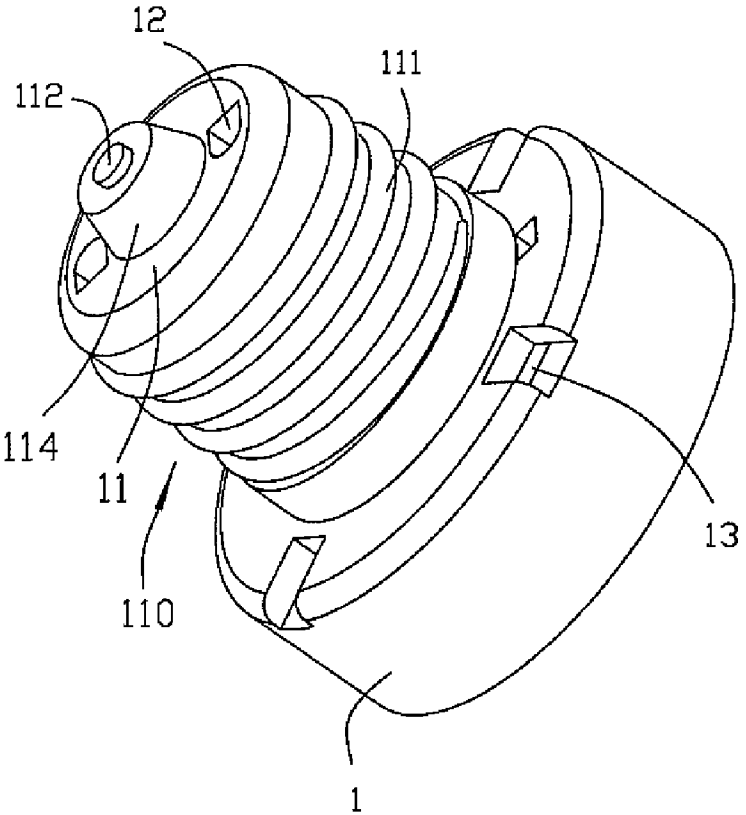
FIG. 4 is a perspective view of an adapter body of the lamp socket adapter as shown in FIG. 1.

Referring to the drawings and initially to FIGS. 1-5, a lamp socket adapter in accordance with the preferred embodiment of the present invention comprises an adapter body 1 having a first side formed with a protruding mounting portion 11, a threaded sleeve 110 mounted on the mounting portion 11 of the adapter body 1 and having an outer wall formed with an outer thread 111, a slot type socket 2 mounted on a second side of the adapter body 1 and formed with two slots 23, two locking bars 3 each mounted between the adapter body 1 and the slot type socket 2 and each having a first end mounted on the slot type socket 2 and a second end which protrudes outwardly from the mounting portion 11 of the adapter body 1 and has a first side formed with an arc-shaped guide face 31 and a second side formed with a flattened locking face 32 located opposite to the arc-shaped guide face 31, and two elastic members 4 each biased between the slot type socket 2 and a respective locking bar 3 to push the respective locking bar 3 toward the adapter body 1 and to push the second end of the respective locking bar 3 outwardly from the mounting portion 11 of the adapter body 1.

The adapter body 1 has a substantially cylindrical shape and has a hollow inside formed with a receiving chamber 10 to receive the slot type socket 2. The first side of the adapter body 1 has a periphery formed with a plurality of locking grooves 13 each connected to the receiving chamber 10. The mounting portion 11 of the adapter body 1 has a substantially cylindrical shape and has a diameter smaller than that of the adapter body 1. The mounting portion 11 of the adapter body 1 has a first end protruding outwardly from the first side of the adapter body 1 and a second end having a periphery formed with two opposite through holes 12 and a central portion formed with a protruding stud 114 for mounting an electrode pole 112.

The adapter body 1 is provided with two opposite conducting plates 113 each located in the receiving chamber 10 and each aligning with a respective slot 23 of the slot type socket 2. The conducting plates 113 are electrically connected to the threaded sleeve 110 and the electrode pole 112 respectively by conducting wires 114. Thus, when two pins of a lamp base are inserted into the slots 23 of the slot type socket 2, the two pins of the lamp base are electrically connected to the threaded sleeve 110 and the electrode pole 112 by the conducting plates 113 so as to form an electrical connection between the lamp base and the slot type socket 2.

The slot type socket 2 is received in and fully hidden in the receiving chamber 10 of the adapter body 1. The slot type socket 2 has a periphery formed with a plurality of locking hooks 22 each extended through the receiving chamber 10 of the adapter body 1 and each locked in a respective locking groove 13 of the adapter body 1. The slot type socket 2 has a side formed with two opposite mounting tubes 21 each extending through the receiving chamber 10 of the adapter body 1 and each receiving a respective elastic member 4 and the first end of a respective locking bar 3.

The two locking bars 3 are arranged symmetrically to produce a evenly distributed moment. Each of the locking bars 3 has a mediate portion formed with an enlarged stop block 30 located between the first end and the second end and movable to rest on the second end of the mounting portion 11 of the adapter body 1 to prevent each of the locking bars 3 from being detached from the mounting portion 11 of the adapter body 1. The arc-shaped faces 31 of the locking bars 3 are directed toward two opposite directions, and the arc-shaped guide face 31 of each of the locking bars 3 is directed toward a rotation direction of the outer thread 111 of the threaded sleeve 110. The second end of each of the locking bars 3 has an arc-shaped transition surface located between the arc-shaped faces 31 and the flattened locking face 32.

The second end of each of the locking bars 3 extends through and protrudes outwardly from a respective through hole 12 of the adapter body 1. Each of the through holes 12 of the adapter body 1 has a first side formed with an arc-shaped first limit face 121 to allow passage of the arc-shaped faces 31 of the respective locking bar 3 and a second side formed with a flattened second limit face 122 to allow passage of the flattened locking face 32 of the respective locking bar 3. Thus, each of the through holes 12 of the adapter body 1 has a cross-sectional profile corresponding to that of the second end of each of the locking bars 3 to facilitate insertion of the second end of each of the locking bars 3 into each of the through holes 12 of the adapter body 1. The arc-shaped first limit faces 121 of the through holes 12 of the adapter body 1 are directed toward two opposite directions, and the arc-shaped first limit face 121 of each of the through holes 12 of the adapter body 1 is directed toward a rotation direction of the outer thread 111 of the threaded sleeve 110 so that each of the locking bars 3 is inserted into the respective through hole 12 of the adapter body 1 exactly.

Each of the elastic members 4 is mounted between the adapter body 1 and the slot type socket 2 and has a first end rested on the slot type socket 2 and a second end rested on the stop block 30 of the respective locking bar 3 to push the stop block 30 of the respective locking bar 3 toward the second end of the mounting portion 11 of the adapter body 1.

Figure 6:
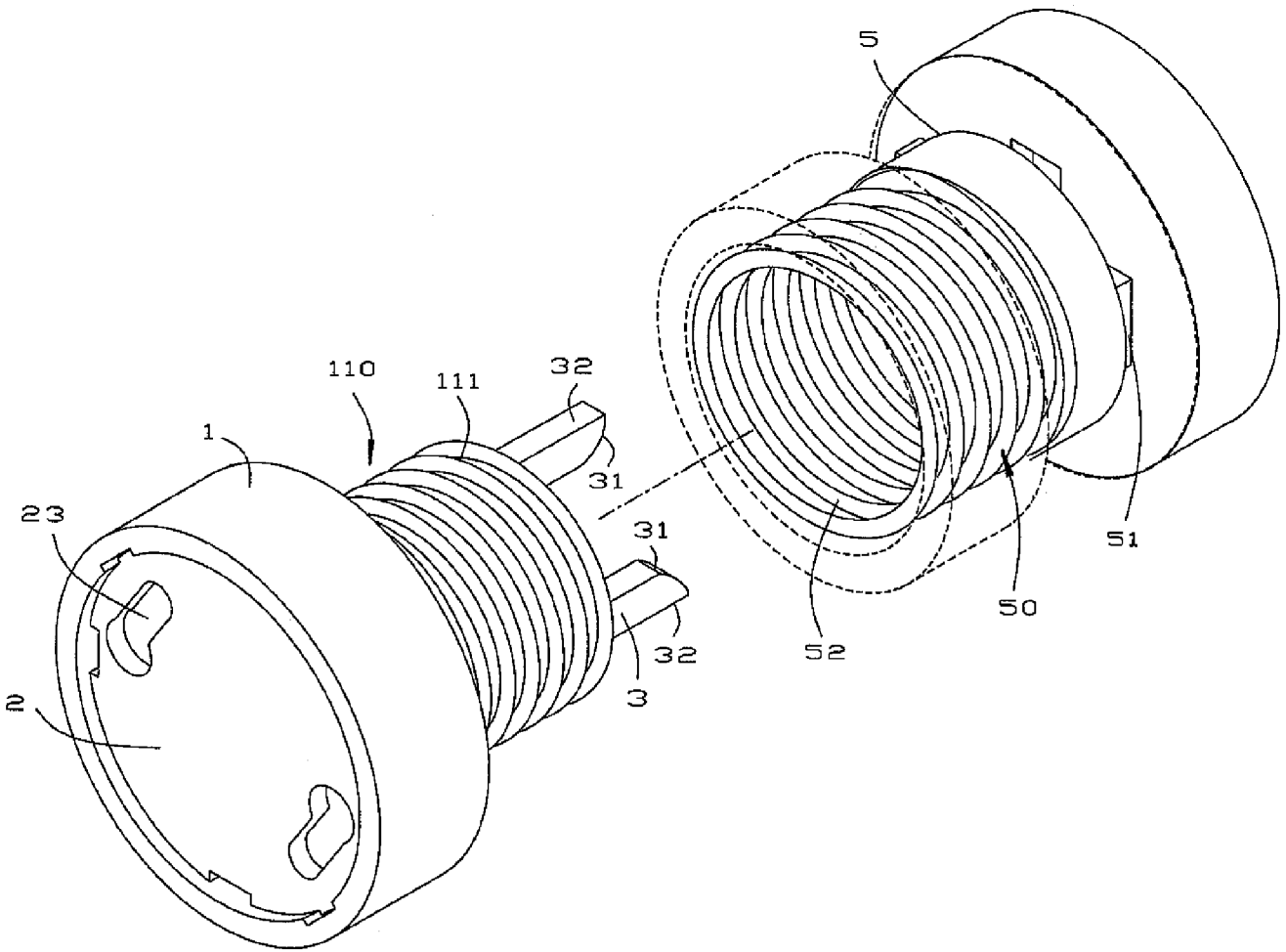
FIG. 6 is an exploded perspective view showing the lamp socket adapter being mounted on a screw type socket.
Figure 7:
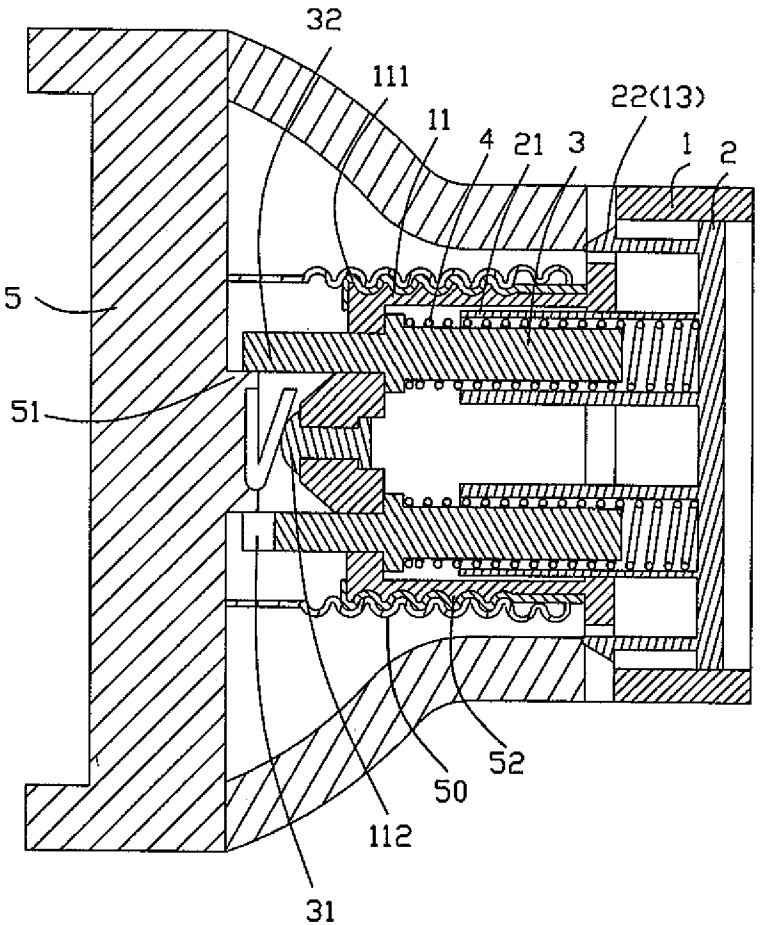
FIG. 7 is a side cross-sectional assembly view of the lamp socket adapter and the screw type socket as shown in FIG. 6.

In operation, referring to FIGS. 6 and 7 with reference to FIGS. 1-5, when the lamp socket adapter is mounted on a screw type socket 5, the adapter body 1 is rotatable relative to the screw type socket 5, and the outer thread 111 of the threaded sleeve 110 is screwed into an inner thread 52 of a mounting stud 50 of the screw type socket 5 so that the slot type socket 2 can replace the screw type socket 5 so as to convert the screw type socket 5 into the slot type socket 2. When the outer thread 111 of the threaded sleeve 110 is fully screwed into the inner thread 52 of the mounting stud 50 of the screw type socket 5, the locking bars 3 are pushed outwardly by the elastic members 4, and the flattened locking faces 32 of the locking bars 3 are locked onto two opposite sides of a crossbar 51 of the screw type socket 5 to lock the locking bars 3 onto the crossbar 51 of the screw type socket 5 so that the adapter body 1 is locked onto the screw type socket 5 deadly and cannot be rotatable relative to the screw type socket 5 in the opposite direction. In such a manner, the two locking bars 3 are arranged symmetrically to produce a evenly distributed moment. Thus, the lamp socket adapter converts the screw type socket 5 into the slot type socket 2 irreversibly. At this time, the arc-shaped guide face 31 of each of the locking bars 3 is directed toward a rotation direction of the outer thread 111 of the threaded sleeve 110 to guide rotation of the outer thread 111 of the threaded sleeve 110 so that the outer thread 111 of the threaded sleeve 110 is screwed into the inner thread 52 of the mounting stud 50 of the screw type socket 5 smoothly and stably.

Accordingly, the lamp socket adapter is mounted on a screw type socket 5 to convert the screw type socket 5 into the slot type socket 2. In addition, the lamp socket adapter converts the screw type socket 5 into the slot type socket 2 irreversibly. Further, the arc-shaped guide face 31 of each of the locking bars 3 is directed toward a rotation direction of the outer thread 111 of the threaded sleeve 110 to guide rotation of the outer thread 111 of the threaded sleeve 110 so that the outer thread 111 of the threaded sleeve 110 is screwed into the inner thread 52 of the mounting stud 50 of the screw type socket 5 smoothly and stably. Further, the locking bars 3 are arranged symmetrically to produce a evenly distributed moment.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A lamp socket adapter, comprising:

an adapter body having a first side formed with a protruding mounting portion;

a threaded sleeve mounted on the mounting portion of the adapter body and having an outer wall formed with an outer thread;

a slot type socket mounted on a second side of the adapter body and formed with two slots;

two locking bars each mounted between the adapter body and the slot type socket and each having a first end mounted on the slot type socket and a second end which protrudes outwardly from the mounting portion of the adapter body and has a first side formed with an arc-shaped guide face and a second side formed with a flattened locking face located opposite to the arc-shaped guide face;

two elastic members each biased between the slot type socket and a respective locking bar to push the respective locking bar toward the adapter body and to push the second end of the respective locking bar outwardly from the mounting portion of the adapter body.

2. The lamp socket adapter in accordance with claim 1, wherein the adapter body has a hollow inside formed with a receiving chamber to receive the slot type socket.

3. The lamp socket adapter in accordance with claim 1, wherein the two locking bars are arranged symmetrically to produce a evenly distributed moment.

4. The lamp socket adapter in accordance with claim 1, wherein each of the locking bars has a mediate portion formed with an enlarged stop block located between the first end and the second end and movable to rest on the second end of the mounting portion of the adapter body to prevent each of the locking bars from being detached from the mounting portion of the adapter body.

5. The lamp socket adapter in accordance with claim 1, wherein the arc-shaped faces of the locking bars are directed toward two opposite directions.

6. The lamp socket adapter in accordance with claim 1, wherein the arc-shaped guide face of each of the locking bars is directed toward a rotation direction of the outer thread of the threaded sleeve.

7. The lamp socket adapter in accordance with claim 1, wherein the second end of each of the locking bars has an arc-shaped transition surface located between the arc-shaped faces and the flattened locking face.

8. The lamp socket adapter in accordance with claim 1, wherein:

the mounting portion of the adapter body has a first end protruding outwardly from the first side of the adapter body and a second end having a periphery formed with two opposite through holes;

the second end of each of the locking bars extends through and protrudes outwardly from a respective through hole of the adapter body.

9. The lamp socket adapter in accordance with claim 1, wherein each of the elastic members is mounted between the adapter body and the slot type socket and has a first end rested on the slot type socket and a second end rested on the stop block of the respective locking bar to push the stop block of the respective locking bar toward the second end of the mounting portion of the adapter body.

10. The lamp socket adapter in accordance with claim 1, wherein the adapter body has a substantially cylindrical shape, and the mounting portion of the adapter body has a substantially cylindrical shape and has a diameter smaller than that of the adapter body.

11. The lamp socket adapter in accordance with claim 1, wherein the second end of the mounting portion of the adapter body has a central portion formed with a protruding stud for mounting an electrode pole.

12. The lamp socket adapter in accordance with claim 2, wherein:

the first side of the adapter body has a periphery formed with a plurality of locking grooves each connected to the receiving chamber;

the slot type socket has a periphery formed with a plurality of locking hooks each extended through the receiving chamber of the adapter body and each locked in a respective locking groove of the adapter body.

13. The lamp socket adapter in accordance with claim 2, wherein the slot type socket has a side formed with two opposite mounting tubes each extending through the receiving chamber of the adapter body and each receiving a respective elastic member and the first end of a respective locking bar.

14. The lamp socket adapter in accordance with claim 8, wherein each of the through holes of the adapter body has a first side formed with an arc-shaped first limit face to allow passage of the arc-shaped faces of the respective locking bar and a second side formed with a flattened second limit face to allow passage of the flattened locking face of the respective locking bar.

15. The lamp socket adapter in accordance with claim 14, wherein the arc-shaped first limit faces of the through holes of the adapter body are directed toward two opposite directions.

16. The lamp socket adapter in accordance with claim 14, wherein the arc-shaped first limit face of each of the through holes of the adapter body is directed toward a rotation direction of the outer thread of the threaded sleeve.

17. The lamp socket adapter in accordance with claim 8, wherein each of the through holes of the adapter body has a cross-sectional profile corresponding to that of the second end of each of the locking bars to facilitate insertion of the second end of each of the locking bars into each of the through holes of the adapter body.

18. The lamp socket adapter in accordance with claim 2, wherein the slot type socket is received in and fully hidden in the receiving chamber of the adapter body.

* * * * *